US012151179B1

(12) United States Patent
Gillespie

(10) Patent No.: US 12,151,179 B1
(45) Date of Patent: Nov. 26, 2024

(54) TOY CAR LAUNCHER

(71) Applicant: Dennis Gillespie, Mount Vernon, OH (US)

(72) Inventor: Dennis Gillespie, Mount Vernon, OH (US)

( * ) Notice: Subject to any disclaimer, the term of this patent is extended or adjusted under 35 U.S.C. 154(b) by 186 days.

(21) Appl. No.: 17/978,308

(22) Filed: Nov. 1, 2022

(51) Int. Cl.
*A63H 17/00* (2006.01)
*A63H 17/26* (2006.01)
*A63H 18/14* (2006.01)

(52) U.S. Cl.
CPC ..... *A63H 17/008* (2013.01); *A63H 17/264* (2013.01)

(58) Field of Classification Search
CPC .. A63H 17/008; A63H 17/264; A63H 18/026; A63H 18/10; A63H 33/26; A63H 18/14
USPC ..... 446/429; 463/61
See application file for complete search history.

(56) References Cited

U.S. PATENT DOCUMENTS 3,751,847 A * 8/1973 Neuhierl ..... A63H 18/14 446/429
4,108,437 A * 8/1978 DeAnda ..... A63H 17/008 463/64
4,273,332 A * 6/1981 Buck ..... A63H 18/005 463/60
4,403,440 A * 9/1983 Wulff ..... A63H 18/026 273/129 S
4,418,495 A * 12/1983 Kennedy ..... A63H 17/26 446/429
4,690,658 A * 9/1987 Crosson ..... A63H 17/008 124/79
4,732,569 A * 3/1988 Hippely ..... A63H 17/008 446/430
4,737,135 A * 4/1988 Johnson ..... A63H 17/008 446/435
4,946,413 A * 8/1990 Lehmann ..... A63H 17/008 446/28
5,052,973 A * 10/1991 Rudell ..... A63H 17/008 124/79
5,433,641 A * 7/1995 Rudell ..... A63H 17/008 446/28
5,767,655 A * 6/1998 Ostendorff ..... A63H 29/22 446/429
5,823,848 A * 10/1998 Cummings ..... A63H 29/24 446/484

(Continued)

FOREIGN PATENT DOCUMENTS

WO 199210260 6/1992

*Primary Examiner* — Alexander R Niconovich
(74) *Attorney, Agent, or Firm* — Kyle A. Fletcher, Esq.

(57) ABSTRACT

The toy car launcher may comprise a launcher housing, a pair of launcher magnets, and one or more toy vehicle magnets. The toy car launcher may be configured to propel a toy vehicle onto a toy vehicle track. The toy vehicle track may detachably 5 couple to the front of the launcher housing. A pusher block within the launcher housing may be retracted and the toy vehicle may be placed into a passage defined by the launcher housing. The pusher block may be moved forward to advance the toy vehicle. Repulsion between the pair of launcher magnets in the launcher housing and the one or more toy vehicle magnets within the toy vehicle may expel the toy vehicle from the launcher housing and onto the toy vehicle track.

19 Claims, 5 Drawing Sheets

(56) References Cited

U.S. PATENT DOCUMENTS

| | | | | | |
|---|---|---|---|---|---|
| 5,974,977 | A * | 11/1999 | Johnson | A63H 18/10 | 104/295 |
| 6,000,992 | A * | 12/1999 | Lambert | A63H 18/026 | 446/444 |
| 7,455,566 | B2 * | 11/2008 | Nelson | A63H 18/14 | 446/130 |
| 8,011,994 | B2 * | 9/2011 | Fink | A63H 18/026 | 446/168 |
| 8,388,405 | B2 * | 3/2013 | Desent | A63H 17/008 | 446/457 |
| 8,696,401 | B2 * | 4/2014 | Ichikawa | A63H 29/20 | 446/429 |
| 9,387,410 | B1 * | 7/2016 | Tao | A63H 18/00 | |
| 9,427,671 | B2 * | 8/2016 | O'Connor | A63H 17/008 | |
| 10,857,474 | B2 * | 12/2020 | Schmid | A63H 17/008 | |
| 11,491,412 | B2 * | 11/2022 | Cao | A63H 18/14 | |
| 2002/0182974 | A1 * | 12/2002 | Grabianski | A63H 17/008 | 446/93 |
| 2010/0112896 | A1 * | 5/2010 | Chang | A63H 18/026 | 446/429 |
| 2014/0106641 | A1 * | 4/2014 | Ichikawa | A63H 29/24 | 446/236 |
| 2019/0262734 | A1 * | 8/2019 | Hong | A63H 29/20 | |
| 2020/0360828 | A1 * | 11/2020 | Han | A63H 18/026 | |

* cited by examiner

TOY CAR LAUNCHER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of propulsion for toys with tracks, more specifically, a toy car launcher.

SUMMARY OF INVENTION

The toy car launcher may comprise a launcher housing, a pair of launcher magnets, and one or more toy vehicle magnets. The toy car launcher may be configured to propel a toy vehicle onto a toy vehicle track. The toy vehicle track may detachably couple to the front of the launcher housing. A pusher block within the launcher housing may be retracted and the toy vehicle may be placed into a passage defined by the launcher housing.

The pusher block may be moved forward to advance the toy vehicle. Repulsion between the pair of launcher magnets in the launcher housing and the one or more toy vehicle magnets within the toy vehicle may expel the toy vehicle from the launcher housing and onto the toy vehicle track.

An object of the invention is to provide a launcher that may couple to a toy vehicle track and may be operable to propel a toy vehicle onto the track.

Another object of the invention is to provide a housing comprising a pair of launcher magnets and one or more toy vehicle magnets that may be coupled to the toy vehicle such that magnetic repulsion between the pair of launcher magnets and one or more toy vehicle magnets propels the toy vehicle.

A further object of the invention is to provide a housing that defines a passage for the toy vehicle to pass through said passage directing the toy vehicle between the pair of launcher magnets.

Yet another object of the invention is to provide a pusher block that may be operable to push the toy vehicle through the passage.

These together with additional objects, features and advantages of the toy car launcher will be readily apparent to those of ordinary skill in the art upon reading the following detailed description of the presently preferred, but nonetheless illustrative, embodiments when taken in conjunction with the accompanying drawings.

In this respect, before explaining the current embodiments of the toy car launcher in detail, it is to be understood that the toy car launcher is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toy car launcher.

It is therefore important that the claims be regarded as including such equivalent construction insofar as they do not depart from the spirit and scope of the toy car launcher. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons 24 skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
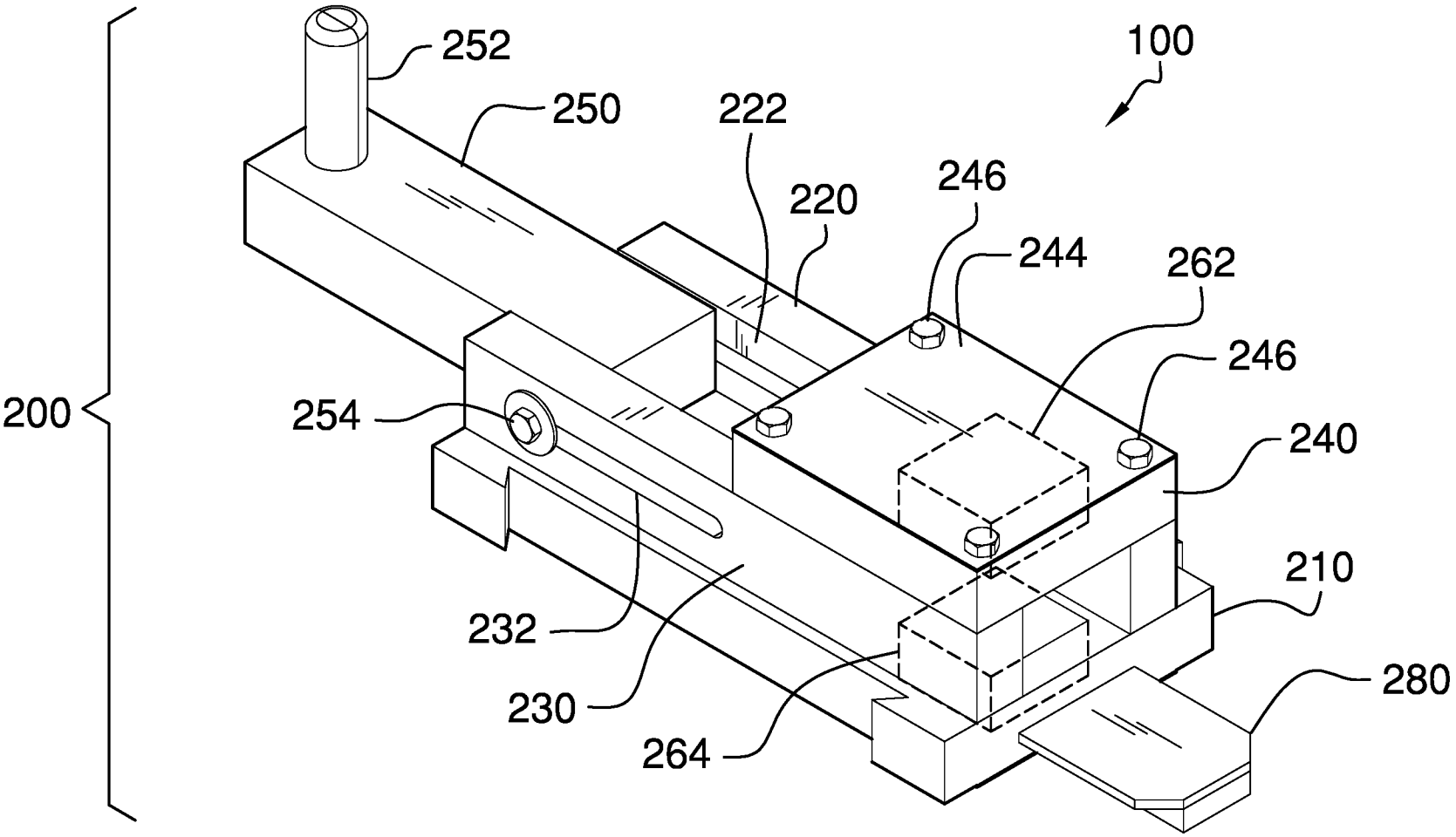
FIG. 1 is an isometric view of an embodiment of the 3 disclosure.
Figure 2:
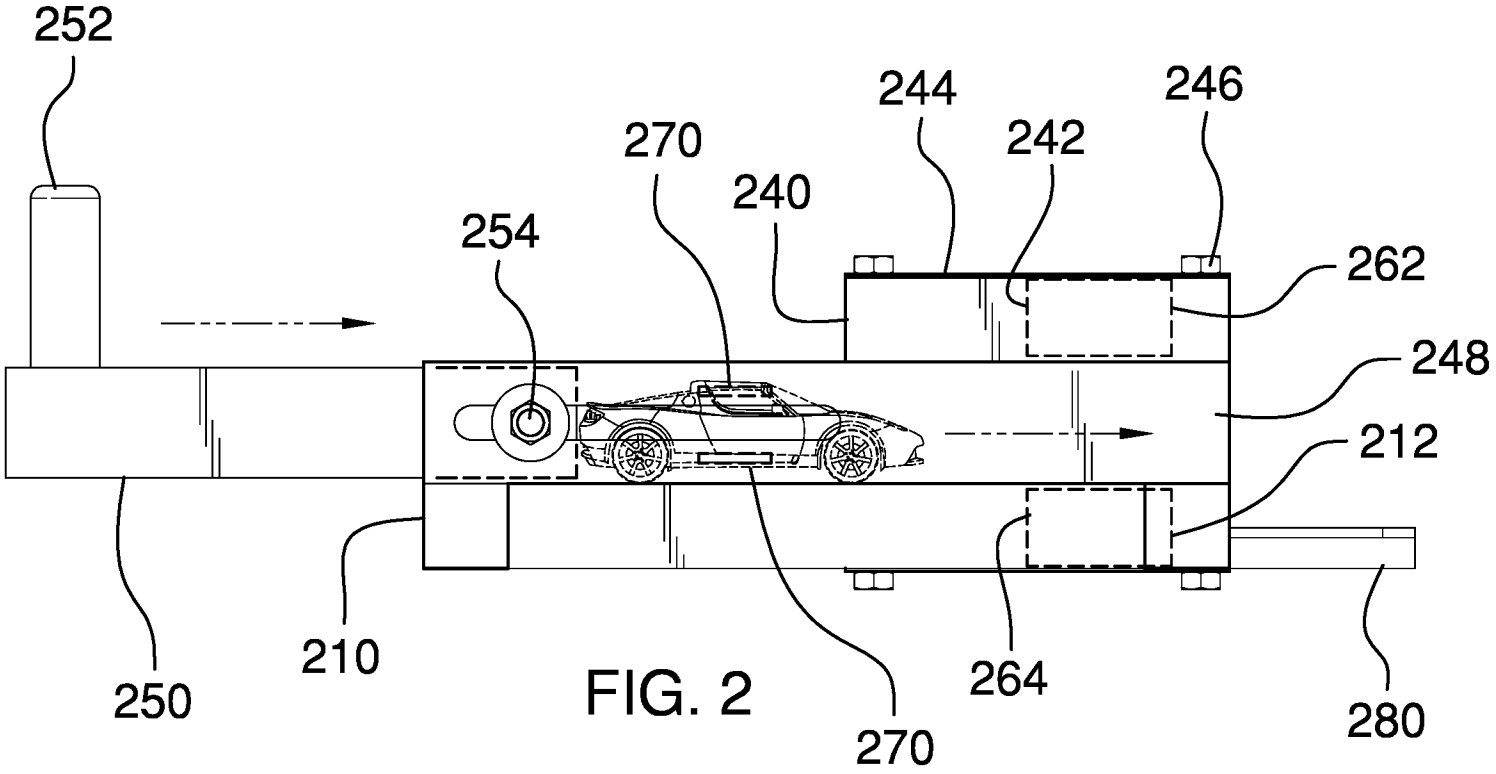
FIG. 2 is a side view of an embodiment of the disclosure.
Figure 3:
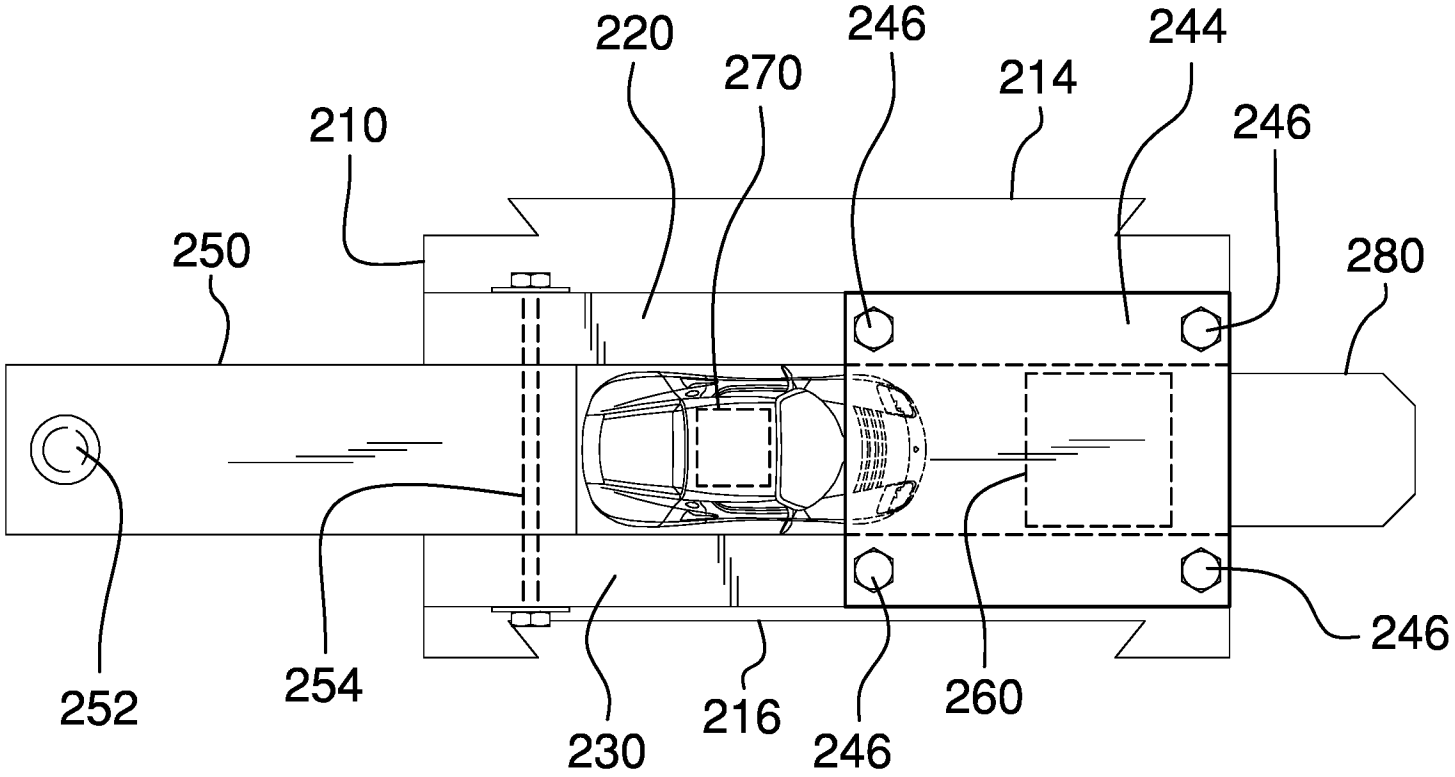
FIG. 3 is a top view of an embodiment of the disclosure.
Figure 4:
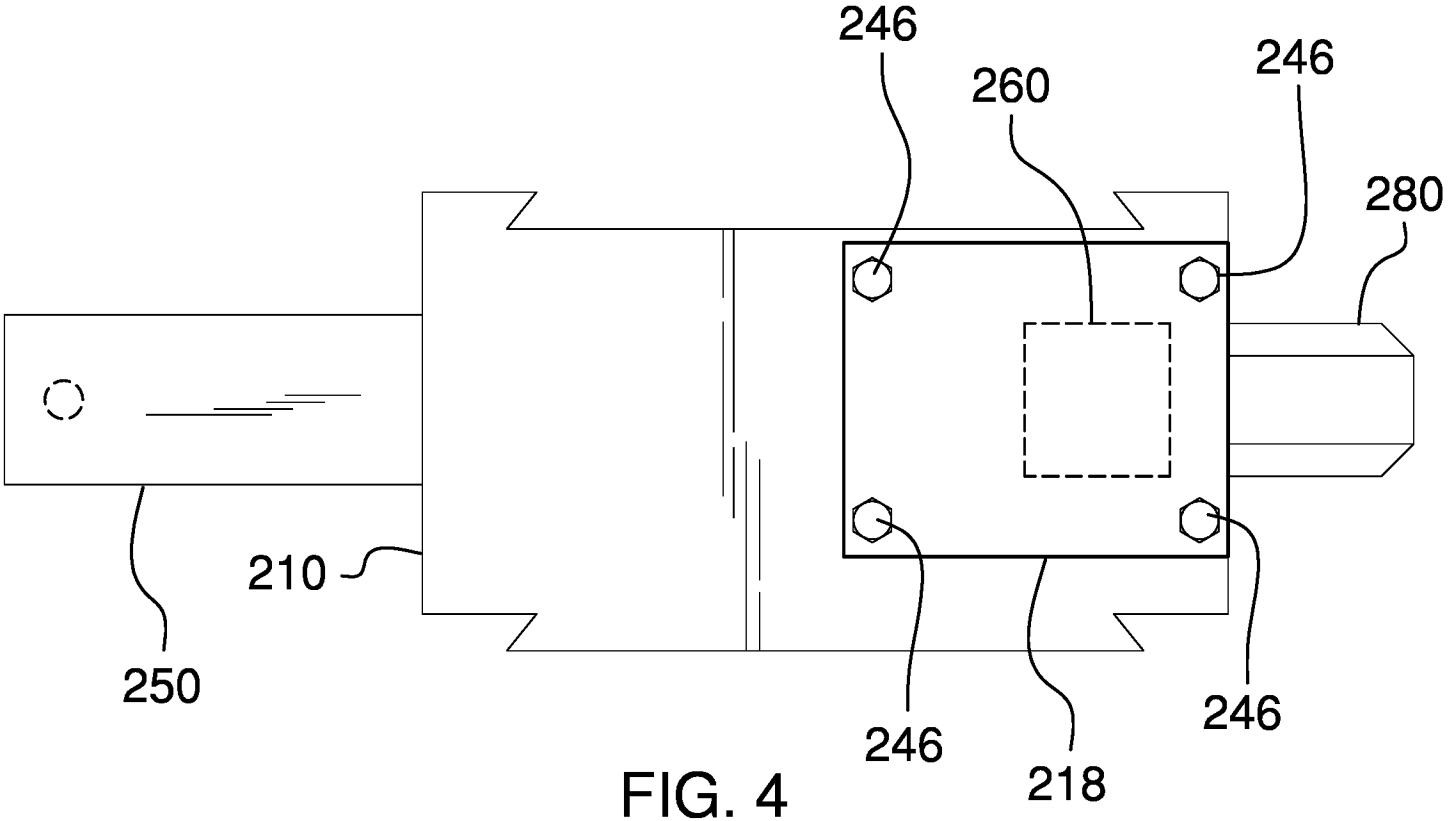
FIG. 4 is a bottom view of an embodiment of the 7 disclosure.
Figure 5:
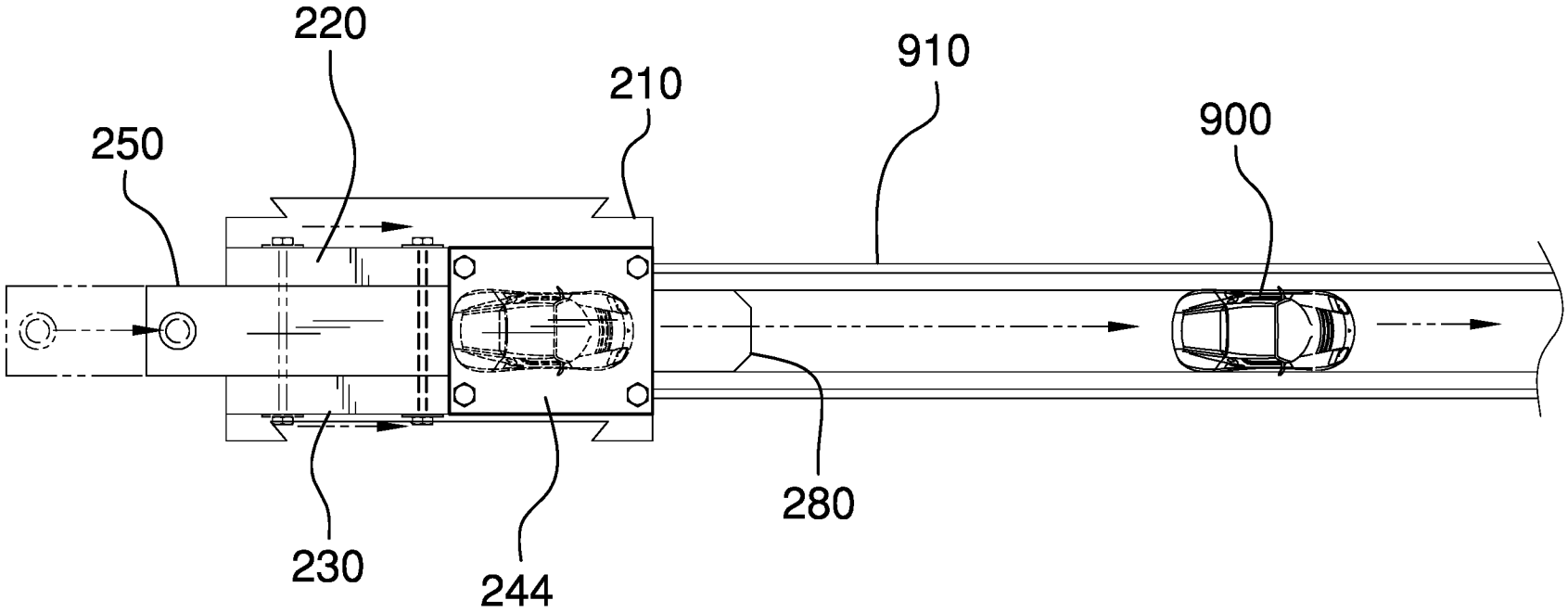
FIG. 5 is a top in-use view of an embodiment of the disclosure.

Detailed reference will now be made to a first potential embodiment of the disclosure, which is illustrated in FIGS. 1 through 5.

The toy car launcher 100 (hereinafter invention) comprises a launcher housing 200, a pair of launcher magnets 260, and one or more toy vehicle magnets 270. The invention 100 may be configured to propel a toy vehicle 900 onto a toy vehicle track 910. The toy vehicle track 910 may detachably couple to the front of the launcher housing 200. A pusher block 250 within the launcher housing 200 may be retracted and the toy vehicle 900 may be placed into a passage 248 defined by the launcher housing 200. The pusher block 250 may be moved forward to advance the toy vehicle 900. Repulsion between the pair of launcher magnets 260 in the launcher housing 200 and the one or more toy vehicle magnets 270 within the toy vehicle 900 may expel the toy vehicle 900 from the launcher housing 200 and onto the toy vehicle track 910.

The launcher housing 200 may comprise a base 210, a left side wall 220, a right side wall 230, a top cover 240, and the pusher block 250. The base 210, the left side wall 220, the right side wall 230, and the top cover 240 may define the passage 248 that the toy vehicle 900 may pass through. The pusher block 250 may be operable to push the toy vehicle 900 through the passage 248.

The base 210 may be the bottom of the launcher housing 200. A base magnet cavity 212 may be located in the front half of the base 210 and may house a lower launcher magnet 264 selected from the pair of launcher magnets 260. The base magnet cavity 212 may be positioned such that the base magnet cavity 212 is located under the center of the passage 248.

The left side of the base 210 may comprise a left side interlock 214 and the right side of the base 210 may comprise a right side interlock 216. The left side interlock 214 and the right side interlock 216 may be operable to detachably couple multiple housings side-by-side. As a non-limiting example, the left side interlock 214 may be a male dovetail and the right side interlock 216 may be a female dovetail. A first housing may be positioned alongside a second housing such that the left side interlock 214 of the first housing interlocks with the right side interlock 216 of the second housing.

In some embodiments, a base plate 218 may couple to the bottom side of the base 210 to close off the bottom of the base magnet cavity 212.

The front of the base 210 may comprise a track connector 280. The track connector 280 may extend forward from the base 210. The size and shape of the track connector 280 may be compatible with the toy vehicle track 910 such that the toy vehicle track 910 may detachably couple to the base 210 by mating with the track connector 280. The track connector 280 may retain the toy vehicle track 910 in a position that aligns the top surface of the toy vehicle track 910 with the top surface of the base 210 such that the toy vehicle 900 experiences a smooth transition from the launcher housing 200 to the toy vehicle track 910 as the toy vehicle 900 exits the launcher housing 200 onto the toy vehicle track 910.

The left side wall 220 may couple to the top of the base on the left side of the base 210. The right side wall 230 may couple to the top of the base 210 on the right side of the base 210. The lateral separation distance between the left side wall 220 and the right side wall 230 may be larger than the width of the toy vehicle 900 such that the toy vehicle 900 may pass through the passage 248.

The left side wall 220 may comprise a left side slot 222 and the right side wall 230 may comprise a right side slot 232. The left side slot 222 may pass laterally through the rear of the left side wall 220 and the right side slot 232 may pass laterally through the rear of the right side wall 230. The left side slot 222 and the right side slot 232 may be operable to guide forward motion of the pusher block 250 by preventing the front of the pusher block 250 from lifting as the pusher block moves forward.

The top cover 240 may be the top of the launcher housing 200. The top cover 240 may be coupled to the tops of the left side wall 220 and the right side wall 230. The top cover 240 may cover the front of the base 210 to define the passage 248. The separation distance between the base 210 and the top cover 240 may be larger than the height of the toy vehicle 900 such that the toy vehicle 900 may pass through the passage 248. The top cover 240 may be shorter than the base 210 in a front-to-rear direction such that an opening remains on the top of the launcher housing 200 for the toy vehicle 900 to be inserted into the passage 248. A top magnet cavity 242 may be located in the front half of the top cover 240 and may house an upper launcher magnet 262 selected from the pair of launcher magnets 260. The top magnet cavity 242 may be positioned such that the top magnet cavity 242 is located above the base magnet cavity 212.

In some embodiments, a top plate 244 may couple to the top side of the top cover 240 to close off the top of the top magnet cavity 242.

As a non-limiting example, the launcher housing 200 may be held together by a plurality of housing bolts 246 that may pass through a plurality of top plate bolt apertures on the top plate 244, a plurality of top cover bolt apertures on the top cover 240, a plurality of left wall bolt apertures and a plurality of right wall bolt apertures on the left side wall 220 and the right side wall 230, a plurality of housing bolt apertures on the base 210, and a plurality of base plate bolt apertures on the base plate 218. The plurality of housing bolts 246 may be retained by a plurality of nuts, flat washers, lock washers, or any combination thereof.

The pusher block 250 may be slidably coupled to the rear of the launcher housing 200. The pusher block 250 may be operable to push the toy vehicle 900 into the passage 248.

The pusher block 250 may comprise a handle 252. The handle 252 may be adapted to be gripped by a user in order to move the pusher block 250 forward and rearward. The pusher block 250 may be slidably coupled to the left side wall 220 and the right side wall 230 via a pusher bolt 254. The pusher bolt 254 may pass through the left side slot 222 on the left side wall 220, a pusher bolt aperture on the pusher block 250, and the right side slot 232 on the right side wall 230. The pusher bolt 254 may be retained by a nut, flat washer, lock washer, or any combination thereof.

The one or more toy vehicle magnets 270 may be placed within the toy vehicle 900. The one or more toy vehicle magnets and the pair of launcher magnets 260 may be oriented such that the pair of launcher magnets 260 repel the one or more toy vehicle magnets 270 of the toy vehicle 900 that is placed into the passage 248. The one or more toy vehicle magnets 270 and the pair of launcher magnets 260 may be secured such that the one or more toy vehicle magnets 270 and the pair of launcher magnets retain positions despite exposure to the magnetic forces between the one or more toy vehicle magnets 270 and the pair of launcher magnets 260. As non-limiting examples, the one or more toy vehicle magnets 270 and the pair of launcher magnets 260 may be secured in place using adhesives, mechanical confinement, mounting hardware, or any combination thereof.

The orientation of the pair of launcher magnets 260 and the one or more toy vehicle magnets 270 may result in repulsion between the toy vehicle 900 and the launcher housing 200 whether the toy vehicle 900 is positioned at the rear of the passage 248 or in front of the passage 248. The toy vehicle 900 may initially be placed into the passage 248 at a point that is behind the pair of launcher magnets 260 such that the pair of launcher magnets 260 may push the toy vehicle 900 to the rear. The pusher block 250 may be adapted to overcome the rearward 12 repulsion as the user pushes the pusher block 250 forward. The 13 direction of the magnetic repulsion may reverse as the toy 14 vehicle 900 is pushed forward and the one or more toy vehicle magnets 270 pass in front of the pair of launcher magnets 260 such that the pair of launcher magnets 260 may push the one or more toy vehicle magnets 270 forward. The toy vehicle 900 may exit the launcher housing 200 travelling in a forward direction and may be guided by the toy vehicle track 910.

The pair of launcher magnets 260 and the one or more toy vehicle magnets 270 may be rare-earth magnets. In a preferred embodiment, the pair of launcher magnets 260 and the one or more toy vehicle magnets 270 may be neodymium magnets which have exceptional strength.

In use, the toy vehicle track 910 may be coupled to the track connector 280. The pusher block 250 may be pulled to the rear and the toy vehicle 900 may be placed into passage.

Magnetic repulsion between the pair of launcher magnets 260 and the one or more toy vehicle magnets 270 in the toy vehicle 900 may push the toy vehicle 900 to the rear, against the pusher block 250. The user may push the pusher block 250 forward-overcoming the magnetic repulsion-until the one or more toy vehicle magnets 270 pass under the pair of launcher magnets 260. As the one or more toy vehicle magnets 270 pass the pair of launcher magnets 260 the direction of the magnetic repulsion May reverse. Magnetic repulsion between the pair of launcher magnets 260 and the one or more toy vehicle magnets 270 may now launch the toy vehicle 900 forward. Magnetic repulsion between the pair of launcher magnets 260 and the one or more toy vehicle magnets may push the toy vehicle 900 out of the launcher housing 200 and onto the toy vehicle track 910.

DEFINITIONS

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used in this disclosure, a "cavity" may be an empty space or negative space that is formed within an object.

As used herein, the words "couple", "couples", "coupled" or "coupling", may refer to connecting, either directly or indirectly, and does not necessarily imply a mechanical connection.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "housing" may be a rigid or semi-rigid casing that encloses and protects one or more devices.

As used in this disclosure, the word "lateral" may refer to the sides of an object or movement towards a side. Lateral directions are generally perpendicular to longitudinal directions. "Laterally" may refer to movement in a lateral direction.

As used in this disclosure, a "magnet" may be an ore, alloy, or other material that has its component atoms arranged so that the material exhibits properties of magnetism such as attracting iron-containing objects or aligning itself in an external magnetic field.

As used herein, "mate" may refer to a retaining, coupling, connecting, interlocking, or interfacing at a predefined interface.

As used herein, "mounting hardware" may refer to mechanical devices that are used to attach one object to another, including devices whose only purpose is to improve aesthetics. As non-limiting examples, mounting hardware may comprise screws, nuts, bolts, washers, rivets, crossbars, hooks, collars, nipples, cams, standoffs, knobs, caps, plates, rails, lips, brackets, or any combination thereof.

As used in this disclosure, "orientation" may refer to the positioning and/or angular alignment of a first object relative to a second object or relative to a reference position or reference direction.

As used herein, "rare-earth magnet" may refer to a permanent magnet made from alloys of rare-earth (lanthanide) elements. Rare-earth magnets may produce magnetic fields that are 2 to 3 times stronger than ferrite or alnico magnets. Examples of rear-earth magnets include, but are not limited to, neodymium magnets and samarium-cobalt magnets.

As used in this disclosure, a "slot" may be a narrow groove, cut, opening, or aperture that is formed in or through an object.

As used in this disclosure, a "track" may be a device that is used to control the path of motion of an object in at least one dimension.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A toy car launcher comprising:

a launcher housing, a pair of launcher magnets, and one or more toy vehicle magnets;

wherein the toy car launcher is configured to propel a toy vehicle onto a toy vehicle track;

wherein the toy vehicle track detachably couples to a front of the launcher housing;

wherein a pusher block within the launcher housing is retracted and the toy vehicle is placed into a passage defined by the launcher housing;

wherein the pusher block is moved forward to advance the toy vehicle;

wherein repulsion between the pair of launcher magnets in the launcher housing and the one or more toy vehicle magnets within the toy vehicle expels the toy vehicle from the launcher housing and onto the toy vehicle track.

2. The toy car launcher according to claim 1 wherein the launcher housing comprises a base, a left side wall, a right side wall, a top cover, and the pusher block;

wherein the base, the left side wall, the right side wall, and the top cover define the passage that the toy vehicle passes through;

wherein the pusher block is operable to push the toy vehicle through the passage.

3. The toy car launcher according to claim 2 wherein the base is a bottom of the launcher housing;

wherein a base magnet cavity is located in a front half of the base and houses a lower launcher magnet selected from the pair of launcher magnets;

wherein the base magnet cavity is positioned such that the base magnet cavity is located under a center of the passage.

4. The toy car launcher according to claim 3 wherein a left side of the base comprises a left side interlock and a right side of the base comprises a right side interlock;

wherein the left side interlock and the right side interlock are operable to detachably couple multiple housings side-by-side.

5. The toy car launcher according to claim 4 wherein the left side interlock is a male dovetail and the right side interlock is a female dovetail;

wherein a first housing is positioned alongside a second housing such that a left side interlock of the first housing interlocks with a right side interlock of the second housing.

6. The toy car launcher according to claim 4 wherein a base plate couples to a bottom side of the base to close off a bottom of the base magnet cavity.

7. The toy car launcher according to claim 6 wherein a front of the base comprises a track connector;

wherein the track connector extends forward from the base;

wherein a size and shape of the track connector are compatible with the toy vehicle track such that the toy vehicle track detachably couples to the base by mating with the track connector;

wherein the track connector retains the toy vehicle track in a position that aligns a top surface of the toy vehicle track with a top surface of the base.

8. The toy car launcher according to claim 7 wherein the left side wall couples to a top of the base on the left side of the base;

wherein the right side wall couples to the top of the base on the right side of the base;

wherein a lateral separation distance between the left side wall and the right side wall is larger than a width of the toy vehicle such that the toy vehicle passes through the passage.

9. The toy car launcher according to claim 8 wherein the left side wall comprises a left side slot and the right side wall comprises a right side slot;

wherein the left side slot passes laterally through a rear of the left side wall and the right side slot passes laterally through a rear of the right side wall;

wherein the left side slot and the right side slot are operable to guide forward motion of the pusher block by preventing a front of the pusher block from lifting as the pusher block moves forward.

10. The toy car launcher according to claim 9 wherein the top cover is a top of the launcher housing;

wherein the top cover is coupled to tops of the left side wall and the right side wall;

wherein the top cover covers the front of the base to define the passage;

wherein a separation distance between the base and the top cover is larger than a height of the toy vehicle such that the toy vehicle passes through the passage;

wherein the top cover is shorter than the base in a front-to-rear direction such that an opening remains on the top of the launcher housing for the toy vehicle to be inserted into the passage;

wherein a top magnet cavity is located in a front half of the top cover and houses an upper launcher magnet selected from the pair of launcher magnets;

wherein the top magnet cavity is positioned such that the top magnet cavity is located above the base magnet cavity.

11. The toy car launcher according to claim 10 wherein a top plate couples to a top side of the top cover to close off a top of the top magnet cavity.

12. The toy car launcher according to claim 11 wherein the pusher block is slidably coupled to a rear of the launcher housing;

wherein the pusher block is operable to push the toy vehicle into the passage.

13. The toy car launcher according to claim 12 wherein the pusher block comprises a handle;

wherein the handle is adapted to be gripped by a user in order to move the pusher block forward and rearward.

14. The toy car launcher according to claim 13 wherein the pusher block is slidably coupled to the left side wall and the right side wall via a pusher bolt;

wherein the pusher bolt passes through the left side slot on the left side wall, a pusher bolt aperture on the pusher block, and the right side slot on the right side wall.

15. The toy car launcher according to claim 14 wherein the one or more toy vehicle magnets are placed within the toy vehicle;

wherein the one or more toy vehicle magnets and the pair of launcher magnets are oriented such that the pair of launcher magnets repel the one or more toy vehicle magnets of the toy vehicle that is placed into the passage;

wherein the one or more toy vehicle magnets and the pair of launcher magnets are secured such that the one or more toy vehicle magnets and the pair of launcher magnets retain positions despite exposure to magnetic forces between the one or more toy vehicle magnets and the pair of launcher magnets.

16. The toy car launcher according to claim 15 wherein the one or more toy vehicle magnets and the pair of launcher magnets are secured in place using adhesives, mechanical confinement, mounting hardware, or any combination thereof.

17. The toy car launcher according to claim 15 wherein orientations of the pair of launcher magnets and the one or more toy vehicle magnets result in repulsion between the toy vehicle and the launcher housing whether the toy vehicle is positioned at a rear of the passage or in front of the passage;

wherein the toy vehicle is initially placed into the passage at a point that is behind the pair of launcher magnets such that the pair of launcher magnets push the toy vehicle to the rear;

wherein the pusher block is adapted to overcome the rearward repulsion as the user pushes the pusher block forward;

wherein a direction of the magnetic repulsion reverses as the toy vehicle is pushed forward and the one or more toy vehicle magnets pass in front of the pair of launcher magnets such that the pair of launcher magnets push the one or more toy vehicle magnets forward;

wherein the toy vehicle exits the launcher housing travelling in a forward direction and is guided by the toy vehicle track.

18. The toy car launcher according to claim 17 wherein the pair of launcher magnets and the one or more toy vehicle magnets are rare-earth magnets.

19. The toy car launcher according to claim 18 wherein the pair of launcher magnets and the one or more toy vehicle magnets are neodymium magnets.

* * * * *